US005783541A

United States Patent [19]

Tack et al.

[11] Patent Number: 5,783,541

[45] Date of Patent: Jul. 21, 1998

[54] UNIT PACKAGED DETERGENT

[75] Inventors: Joris Josef Gustaaf Tack, Rome, Italy; Jean-Luc Andre Varlet, Uccle; Bruno Van De Pol, Mechelen, both of Belgium

[73] Assignee: Procter & Gamble Company, Cincinnati, Ohio

[21] Appl. No.: 793,884

[22] PCT Filed: Sep. 1, 1995

[86] PCT No.: PCT/US95/11165

§ 371 Date: Mar. 12, 1997

§ 102(e) Date: Mar. 12, 1997

[87] PCT Pub. No.: WO96/08555

PCT Pub. Date: Mar. 21, 1996

[30] Foreign Application Priority Data

Sep. 12, 1994 [EP] European Pat. Off. ..... 94870148

[51] Int. Cl.[6] ..... C11D 11/00; C11D 17/00; C11D 3/37

[52] U.S. Cl. ..... 510/224; 510/439; 510/441; 510/446; 510/451; 510/475

[58] Field of Search ..... 510/224, 439, 510/441, 446, 451, 475

[56] References Cited

U.S. PATENT DOCUMENTS 3,198,740 8/1965 Dunlop, Jr. et al. .
4,115,292 9/1978 Richardson et al. .
4,348,293 9/1982 Clarke et al. .
4,622,161 11/1986 Cornelissens et al. .
4,747,976 5/1988 Yang et al. .
4,972,017 11/1990 Smith et al. .
5,198,198 3/1993 Gladfelter et al. .
5,234,615 8/1993 Gladfelter et al. .
5,384,364 1/1995 Besse et al. .

FOREIGN PATENT DOCUMENTS 62-13500 1/1987 Japan .

OTHER PUBLICATIONS

Research Disclosure 21606, Apr. 1982, pp. 105–106.

*Primary Examiner*—Paul Lieberman
*Assistant Examiner*—Lorna M. Douyon
*Attorney, Agent, or Firm*—Richard S. Echler, Sr.; B. M. Bolam; K. W. Zerby

[57] ABSTRACT

A unit packaged detergent comprises a detergent composition wrapped in a film made of a water-dissolvable material. The water-dissolvable material protects the wrapped detergent from dissolution until the start of a main wash of a dishwashing machine. At least one outer side of the water-dissolvable material is provided with a coating of a water-dissolvable glue.

8 Claims, No Drawings

UNIT PACKAGED DETERGENT

FIELD OF THE INVENTION

The present invention relates to packaged detergent and/or additive composition for the dish washing machine.

BACKGROUND OF THE INVENTION

The traditional form of detergent and/or additive compositions for use in dish washing is granules or non particulate solids such as bars or tablets or briquettes. In the following, the term tablet will refer to any form of non particulate solids. For automatic dish washing machines, said detergent and/or additive tablets or granules are respectively placed or poured in the dispenser located in said dish washing machine or in an adequate dispensing device which is then placed in said washing machine.

In order to simplify the dosing of detergents for a washing cycle in a machine and to avoid wasting through spillage during the dosing action, EP-B-0 388 105 (=D1) describes a unit packaged detergent. Said unit packaged detergent is a detergent packaged in a water soluble polymer film or sheet in such a form that it is suitable for one wash. This unit packaged detergent is placed in the machine without unwrapping the contained detergent from the packaging. This is possible, since said packaging is made of a water dissolvable polymer film. To avoid the unwrapping of the detergent from the packaging has several advantages. First, said unit packaged detergent prevents wasting through spillage of the detergent and/or additive composition. Second, said unit packaged detergent eliminates the need for the user to estimate the dosage of said composition required and ensures that the correct dosage of said composition per wash cycle is used by the user. Third, the fingers of a user do not come in contact with the wrapped detergent composition.

The problem of D1 is to provide a polymer film with increased solubility to avoid remnants of gel or jelly of insoluble polymer film which may adhere to the washed clothes. This problem is solved by developing a polymer having a dissolution time in water of less than 20 sec at 20° C. But this development cannot be readily applied in an automatic dish washing machine.

Indeed, we found that there is a sub-optimum washing performance obtained with a detergent packaged as in D1, as compared to the same amount of the detergent, but introduced through the dispenser of the dish washing machine. We have identified the cause for this sub-optimum performance, which is a loss of detergent in the initial rinse cycle prior to the main wash cycle in a dish washing machine. The initial rinse cycle is a prewash with cold water of the tap (10° C. to 20° C.) without detergent and lasting for about 10 min to 15 min. Consequently, we have determined that the packaging as described in D1 dissolves completely releasing the contained detergent in the water of the initial rinse cycle, i.e. part of the detergent dissolves during the initial rinse cycle. The sub-optimum washing performance is a consequence of the dissolution of part of the detergent during the initial rinse cycle, since it is lost for the main wash.

Therefore, we have found that to avoid a precocious dissolution of the detergent, the unit packaged detergent described in the prior art has to be protected from the water of the initial rinse cycle. A possible solution would be to place the unit packaged detergent of the prior art inside the dispenser of the dish washing machine which opens only with the start of the main wash cycle. But this may cause logistic problems. Indeed, the dimension and the shape of the unit packaged detergent is then limited by the dimension and the shape of the dispenser of the dish washing machine. This limitation could be especially a problem when the unit packaged detergent contains detergent in solid form, like tablets, which may not have the dimension and the shape of the dispenser. As a consequence, it is possible that such a unit packaged detergent containing a tablet cannot be used in that particular washing machine without avoiding a decreased washing performance.

It is therefore an object of the present invention to provide a unit packaged detergent which shows no decrease of washing performance when the washing machine has a initial rinse and a main wash cycle without the need to place said unit packaged detergent into the dispenser of the washing machine.

Another object of the present invention is the method of manufacture of the unit packaged detergent according to the present invention.

SUMMARY OF THE INVENTION

The present invention provides a unit packaged detergent for automatic dish washing. Said unit packaged detergent comprises a detergent composition wrapped in a film made of a water dissolvable material. Said water dissolvable material protects the wrapped detergent from dissolution until the start of the main wash in a dish washing machine.

DETAILED DESCRIPTION OF THE INVENTION

In the following any detergent and/or additive compositions will be encompassed by the term "detergent". This detergent composition may be in the form of granules or of any non particulate solids such as bars or tablets or briquettes. The word "tablet" encompasses in the following any form of non particulate solids. Said tablet may have any shape. Preferably, said solid non particulate detergent tablet is symmetrical to ensure the uniform dissolution of the tablet in the wash liquor. According to the present invention the detergent and/or additive composition may comprise any ingredients known in the art for dish washing. Such ingredients may include surfactants, suds suppressers, bleaches, chelants, builders, enzymes, fillers and perfumes.

According to the present invention, a predosed quantity of detergent is wrapped in a packaging to form a unit packaged detergent. The wording "unit packaged detergent" means a packaged amount of detergent suitable for one wash. Nevertheless, two or more unit packaged detergents according to the present invention may be used in a single wash to meet different washing conditions, like dirtiness of washing, amount of washing, volume of washing machine, hardness of water, temperature of water and type of detergent. Said packaging is made of a water dissolvable material. The unit packaged detergent according to the present invention may contain between 3 g and 100 g of detergent, more preferably between 10 g and 50 g, most preferably between 25 g and 35 g of detergent.

As an essential feature of the present invention, the packaging of the unit packaged detergent is made of a material which dissolves in water, but which protects the wrapped detergent from dissolution until the start of the main wash in a dish washing machine. Indeed, most of the automatic dish washing machines, may perform a initial rinse cycle before the main cycle. The initial rinse cycle is a prewash with cold water of the tap (about 20° C. or less) without detergent and lasting for about 10 to 15 min. The material of the packaging of said unit packaged detergent should not dissolve completely in the initial rinse cycle. A packaging that completely dissolves means that the content of said packaging is not protected anymore from dissolution. For example, a detergent contained in said packaging would be available for dissolution during the initial rinse cycle. The part of the detergent dissolved during the initial rinse cycle is wasted, since this dissolved part is lost for the main wash.

On the other hand, once the main cycle starts the detergent should be available for dissolution as soon as possible, also in case that there was no pre-dissolution of the packaging during the initial rinse cycle. This is especially important for laundry washing machines which usually only comprise the main wash. The main wash is the washing with detergent in the washing machines performed at temperatures greater than 20° C., more preferably at 30° C. or more.

According to the present invention the above problem is solved by choosing a water dissolvable material having a dissolution time which strongly depends from the water temperature. Specifically, the dissolution time of said material has to be such that it is not completely dissolved within 10 min to 15 min at a water temperature of 20° C. or less, i.e. said material does not dissolve during the initial rinse cycle. Whereas at temperatures above 20° C., preferably at temperatures starting from 30° C., the same material dissolves completely in 2 min or less, preferably within 1 min. In this manner, the detergent wrapped within this material is protected from dissolution in the initial rinse cycle, but is readily available for dissolution in the main wash. Therefore, a unit packaged detergent, comprising an amount of detergent wrapped in a water dissolvable material as described before, does not need to be placed in the dispenser of the washing machine. On the contrary, said unit packaged detergent can be placed anywhere in the washing machine together with the dishes or with the laundry.

This unit packaged detergent of the present invention is placed in the machine without unwrapping the contained detergent from the packaging. This is possible, since said packaging is made of a water dissolvable material, as described above. To avoid the unwrapping the detergent from the packaging has several advantages. First, said unit packaged detergent prevents wasting through spillage of the detergent and/or additive composition. Spillage may occur during the measuring and/or dispensing into the dispenser of the washing machine or into a dispensing device. Second, said unit packaged detergent eliminates the need for the user to estimate the dosage of said composition required and ensures that the correct dosage of said composition per wash cycle is used by the user. Therefore, separate measuring and/or dosing devices are superfluous. Third, the fingers of a user do not come in contact with the wrapped detergent composition, which means that the user avoids to soil its fingers and/or hands. Fourth, said unit packaged detergent can be placed in a washing machine at any place together with the dish or the laundry.

Preferably, water dissolvable polymers are used as water dissolvable materials for said unit packaged detergent. Preferably, polyvinyl alcohol (=PVOH) may be used as water dissolvable packaging material of said detergent tablet. PVOH is a hygroscopic material, i.e. this material dissolves in water. The rate of dissolution in water depends from the thickness of said water dissolvable material used, the molecular weight of said material and the temperature of the water. A fast rate is achieved by decreasing the thickness and/or the molecular weight of said water dissolvable material and/or increasing the temperature of the water. Preferably, the present invention uses water dissolvable polymeric materials of thicknesses between 10 μm and 30 μm, more preferably between 20 μm and 30 μm at a molecular weight between 50,000 and 200,000, more preferably between 80,000 and 150,000. For example, taking a unit packaged detergent made of a 30 μm thick PVOH film with a molecular weight of 100,000 and which contains 30 g of detergent does not dissolve completely after 15 min at 20° C. water temperature, and within 2 min at 30° C. water temperature. This means that the wrapped detergent is protected from a precocious dissolution during the initial rinse cycle, whereas said wrapped detergent is made readily available for dissolution in the main washing cycle.

As preferred options, said unit packaged detergent may be a bag which contains substantially in a loose manner the detergent or an additional layer on the outer surface of a detergent tablet. Preferably, said unit packaged detergents are delivered in a container made of any material, like carton, plastic or metal. As a preferred option, said unit packaged detergents may be packed and sold in a string, each unit packaged detergents being individually separable by a perforation line. Therefore, each unit packaged detergent can be individually torn off from said string and placed without unwrapping the contained detergent in the washing machine. As other options, said packaging material of the unit packaged detergent may be translucent, opaque or having a printed side.

As another preferred option, said unit packaged detergent may comprise also an additive which provides an unbearable bitter taste. This additive may be coated onto said unit packaged detergent. This improves the prevention that children may accidentally ingest the complete packaging detergent. Such an additive is for example a trademark called BITREX™.

As a further optional preferred embodiment of the present invention, said unit packaged detergent may be provided with a glue coating being on at least one side of said packaging. In this manner, said packaging wrapping said detergent tablet may be stuck on any place of a dish washing machine, as convenient for the load to be washed and cleaned. For example the side walls, the front or top door are possible places where said unit packaged detergent may be stuck in said washing machine. Preferably, said glue is water dissolvable or dissolves upon the effect of temperature. Preferably, said glue coating has the same or less water solubility than the packaging. In this manner, the unit packaging detergent is prevented to fall before the start of the main wash cycle. Then said unit packaged detergent falls into the wash liquor to allow the complete dissolution of said unit packaged detergent, i.e. rest of packaging and contained detergent. The glue coating may be protected with a protective sheet of paper or else which can be easily removed. The protective sheet prevents sticking of, for example, dust particles on the glue coating which could diminish the sticking properties of said glue coating. The glue coating may be provided for example by a layer of polyurethane on the outer surface of said unit packaged detergent.

The unit packaged detergent according to the present invention may be manufactured in the following way:

- the detergent composition is prepared in its granular or particulate form;
- if appropriate, the granular or particulate detergent composition may be formed into a tablet of the desired shape and size by any of the method selected from the group of: compression, extrusion and casting, whereas said detergent composition is homogeneously distributed throughout the tablet or comprises different layers of certain detergent ingredients;

a water dissolvable material is prepared in form of a film;

if appropriate, said water dissolvable film may be also provided with a coating of a water dissolvable glue, this coating preferably on the side of said water dissolvable film being on the outer side of the unit packaged detergent;

then said detergent in granular or tablet form is wrapped into said water dissolvable film to form the unit packaged detergent;

the water dissolvable film is sealed around said detergent so that said film forms a layer directly attached to the outer surface of said tablet, or so that said film forms a bag containing said detergent;

if necessary, a perforation line is added between each unit packaged detergent in a string of unit packaged detergents, otherwise each unit packaged detergent is cut from each other.

The unit packaged detergent according to the present invention may be used in the following manner:

a unit packaged detergent necessary for a dish wash cycle in an automatic washing machine is taken from a container, if needed by tearing off a unit packaged detergent along the perforation line in a string of several unit packaged detergents;

said unit packaged detergent is placed into a dish washing machine together with the dish without unwrapping said detergent.

if appropriate, to stick said unit packaged detergent at any convenient place in the machine.

What is claimed is:

1. A unit packaged detergent for dish washing, said unit packaged detergent comprising a detergent composition wrapped in a film made of a water dissolvable material, wherein said water dissolvable material protects the wrapped detergent from dissolution until the start of a main wash of a dish washing machine, and further wherein at least one outer side of the water dissolvable material is provided with a coating of a water dissolvable glue.

2. A unit packaged detergent according to claim 1 wherein said water dissolvable material has a thickness of between 10 μm and 30 μm and a molecular weight between 50,000 and 200,000.

3. A unit packaged detergent according to claim 2 wherein said water dissolvable material is polyvinyl alcohol.

4. A unit packaged detergent according to claim 1 wherein said water dissolvable material does not dissolve completely within 15 min at a water temperature of 20° C. or less, but does dissolve completely in 2 min or less at a water temperature of 30° C. or more.

5. A unit packaged detergent according to claim 1 wherein an additive is added to said water dissolvable material to give a bitter taste to said material.

6. A method of manufacturing the unit packaged detergent according to claim 1, comprising the steps of preparing the detergent composition in its granular or particulate form;

optionally forming the granular or particulate detergent composition into a tablet of a desired shape and size by any method selected from the group consisting of compression, extrusion and casting, wherein said detergent composition is homogeneously distributed throughout the tablet or comprises different layers of detergent ingredients;

preparing a water dissolvable material in film form;

providing a coating of water dissolvable glue on an outer side of the water dissolvable film;

wrapping said detergent in granular or tablet form into said water dissolvable film to form the unit packaged detergent so that said film forms a layer directly attached to the outer surface of said tablet or so that said film forms a bag containing said detergent, wherein the coating is on the outer side of the unit packaged detergent; and optionally adding a perforation line between each unit packaged detergent or cutting each unit packaged detergent from each other, in a string of unit packaged detergents.

7. A method of using a unit packaged detergent according to claim 1, comprising the steps of:

taking a unit packaged detergent necessary for a dish wash cycle in an automatic washing machine from a container, optionally by tearing off a unit packaged detergent along a perforation line in a string of unit packaged detergents; and placing said unit packaged detergent into a washing machine together with a dish without unwrapping said unit packaged detergent.

8. A method according to claim 7 wherein said unit packaged detergent is stuck at any convenient place in the machine.

* * * * *